US010108133B1

(12) United States Patent
Kimura

(10) Patent No.: US 10,108,133 B1
(45) Date of Patent: Oct. 23, 2018

(54) IMAGE FORMING APPARATUS

(71) Applicant: KYOCERA Document Solutions Inc., Osaka (JP)

(72) Inventor: Keigo Kimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/977,227

(22) Filed: May 11, 2018

(30) Foreign Application Priority Data

May 26, 2017 (JP) ..... 2017-104252

(51) Int. Cl.
*G03G 21/00* (2006.01)

(52) U.S. Cl.
CPC ..... *G03G 21/0058* (2013.01); *G03G 21/0011* (2013.01); *G03G 21/0076* (2013.01)

(58) Field of Classification Search
CPC ..... G03G 21/0058; G03G 21/0011; G03G 21/0076
See application file for complete search history.

(56) References Cited

U.S. PATENT DOCUMENTS

2006/0115292 A1* 6/2006 Sampe ..... G03G 15/0225 399/100

FOREIGN PATENT DOCUMENTS

JP 2005-345505 A 12/2005
JP 2007-199379 A 8/2007

* cited by examiner

*Primary Examiner* — Billy Lactaoen
(74) *Attorney, Agent, or Firm* — Studebaker & Brackett PC

(57) ABSTRACT

A cleaning device includes a cleaning roller, a cleaning blade, a toner layer forming member and a regulating member. The cleaning roller comes into contact with a surface of a rotating image carrier and rotates. The cleaning blade comes into contact with the image carrier at a downstream side from the cleaning roller in a rotating direction of the image carrier and scrapes toner adhered to the image carrier. The toner layer forming member receives and collects the toner scraped by the cleaning blade and feeds the toner to the cleaning roller to form a toner layer on the cleaning roller. The regulating member comes into contact with the cleaning roller to regulate thickness of the toner layer. The regulating member is controlled so as to thicken thickness of the toner layer formed on the cleaning roller as rotating rate of the image carrier becomes slower.

10 Claims, 4 Drawing Sheets

IMAGE FORMING APPARATUS

INCORPORATION BY REFERENCE

This application is based on and claims the benefit of priority from Japanese Patent application No. 2017-104252 filed on May 26, 2017, the entire contents of which are incorporated herein by reference.

BACKGROUND

The present disclosure relates to a cleaning device cleaning a toner remained on an image carrier and an image forming apparatus including this cleaning device.

In an image forming apparatus, such as a copying machine and a printer, an electrostatic latent image formed on a photosensitive drum is developed to a toner image by a developing device. The developed toner image is transferred onto a transferred medium, such as a sheet, from the photosensitive drum. At this time, the toner image may not be transferred perfectly and may be remained on the photosensitive drum. To the photosensitive drum, discharge product produced when the electrostatic latent image is formed on photosensitive drum may be adhered. Such remained toner and discharge product may interfere with new image forming and may cause transfer failure.

By contrast, the image forming apparatus is provided with a cleaning device removing the remained toner and the discharge product adhered to the photosensitive drum. The cleaning device includes a cleaning roller coming into contact with the photosensitive drum and rotating.

The cleaning roller not only removes adhered substance from the photosensitive drum, but also carries a toner layer to grind a surface of the photosensitive drum by the toner layer. In order to let the cleaning roller carry the toner layer, the toner scraped from the photosensitive drum is collected by a toner layer forming member and the toner is fed from the toner layer forming member to the cleaning roller.

Incidentally, the image forming apparatus is configured so that, in a case where the transferred media is a cardboard, considering strength of stiffness of the cardboard, conveying speed of the cardboard is set slower than conveying speed of a plain paper. That is, rotating rate (linear velocity) of the photosensitive drum in a case of the cardboard is set slower than rotating rate in a case of the plain paper. If the rotating rate of the photosensitive drum is slow, there is a problem that image flow occurs. The image flow is a phenomenon that water-soluble discharge product (e.g. an oxide, such as NOx) is adhered to the surface of the photosensitive drum, and accordingly, the toner image like a flow is formed on the surface.

This phenomenon remarkably occurs especially in a case there the photosensitive drum is an amorphous silicon photoreceptor with high hardness. In a case where the photosensitive drum is an organic photoreceptor, if discharge product is adhered, because the surface of the photosensitive drum is shaven by a cleaning blade, and then, a new face tends to be made, such a problem is hardly caused.

The image flow is caused in a situation that a surface resistance of the photosensitive drum is decreased when moisture is adhered to the discharge product, and accordingly, a surface charge flows on the surface to become ununiformity. Moreover, the surface charge may flow an exposed part of the photosensitive drum.

Accordingly, as a time between charging and exposing and a time between exposing and developing are lengthened, the image flow occurs more remarkable. That is, as the rotating rate of the photosensitive drum becomes slower, the image flow occurs more remarkable. Therefore, as the rotating rate of the photosensitive drum becomes slower, it is necessary to more improve cleaning performance of the photosensitive drum by the cleaning device.

For example, there is an image forming apparatus increasing an amount of the toner fed from the developing device to the photosensitive drum in a case where rotating rate of the photosensitive drum is varied. If the amount of the toner fed to the photosensitive drum is increased, an amount of the toner removed by the cleaning device is increased. As a result, much toner is fed to the cleaning roller and thickness of the toner layer made on the cleaning roller becomes thick, and then, performance grinding the surface of the photosensitive drum is improved.

In addition, there in another image forming apparatus heightening rotating rate of a rubbing roller (the cleaning roller) in image forming operation in comparison with rotating rate of the photosensitive drum and heightening rotating rate of the rubbing roller in non-image forming operation in comparison with the rotating rate in image forming operation. When the rotating rate of the rubbing roller is heightened in comparison with the rotating rate of the photosensitive drum, occurrence of a dash mark is restrained. When the rotating rate of the rubbing roller in non-image forming operation is heightened in comparison with the rotating rate in image forming operation, grinding force to the photosensitive drum is improved.

However, in the above-mentioned image forming apparatus, there are a problem that consumption of the toner is increased and a problem that the rotating rate of the photosensitive drum becomes unstable and an image noise of a striped pattern (a jitter noise) occurs. Moreover, there is a problem that rate control of the rubbing roller is complicated in a case where the rotating rate of the photosensitive drum is varied according to thickness of the sheet.

SUMMARY

In accordance with an embodiment of the present disclosure, a cleaning device includes a cleaning roller, a cleaning blade, a toner layer forming member and a regulating member. The cleaning roller comes into contact with a surface of a rotating image carrier and rotates. The cleaning blade comes into contact with the image carrier at a downstream side from the cleaning roller in a rotating direction of the image carrier and scrapes toner adhered to the image carrier. The toner layer forming member receives and collects the toner scraped by the cleaning blade and feeds the toner to the cleaning roller to form a toner layer on the cleaning roller. The regulating member comes into contact with the cleaning roller to regulate thickness of the toner layer. The regulating member is controlled so as to thicken thickness of the toner layer formed on the cleaning roller as rotating rate of the image carrier becomes slower.

In accordance with an embodiment of the present disclosure, an image forming apparatus includes the image carrier and the cleaning device.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

In the following, with reference to the drawings, a cleaning device and an image forming apparatus according to an embodiment of the present disclosure will be described.

Figure 1:
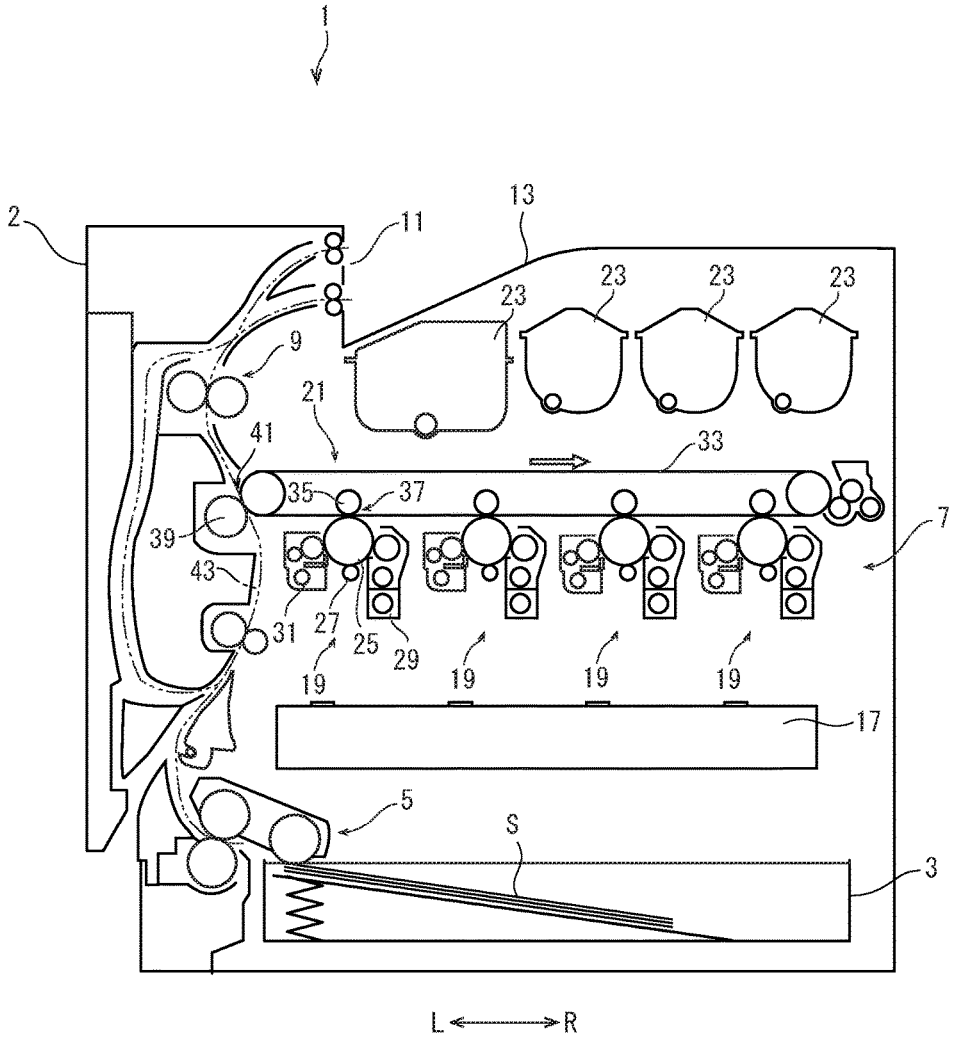
FIG. 1 is a sectional view schematically showing internal structure of a color printer according to an embodiment of the present disclosure.
Figure 2:
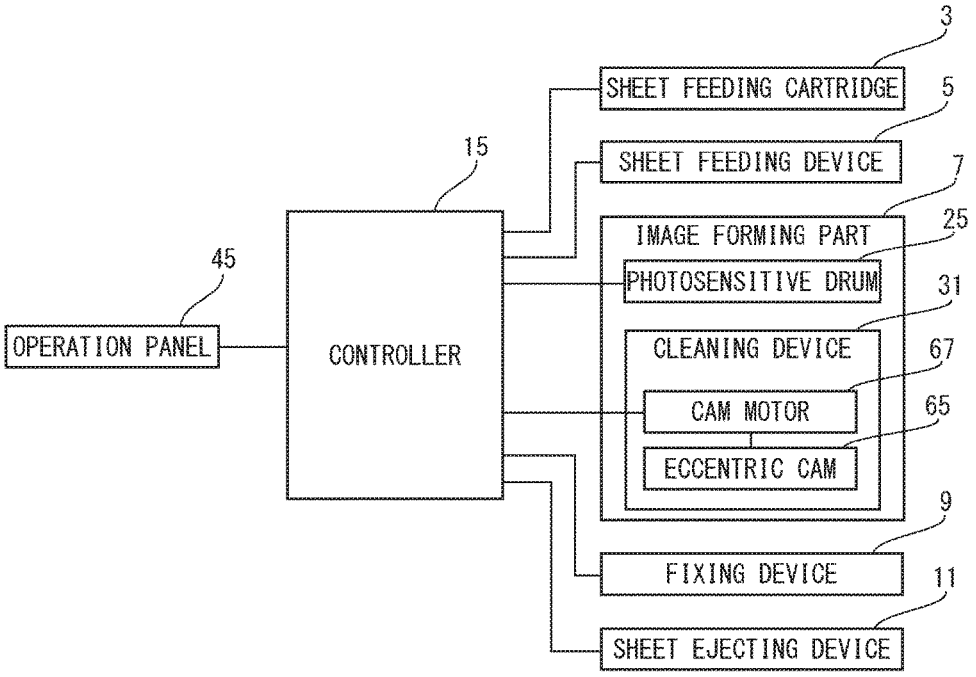
FIG. 2 is a block diagram showing a controller of the color printer according to the embodiment of the present disclosure.

First, with reference to FIGS. 1 and 2, entire structure of a color printer 1 as the image forming apparatus will be described. FIG. 1 is a sectional view schematically showing the color printer according to an embodiment of the present disclosure and FIG. 2 is a block diagram of a controller 15. Hereinafter, it will be described so that the front side of the color printer 1 is positioned at a near side on a paper sheet of FIG. 1 and that left and right directions is defined as seen from the front side of the color printer 1. Arrows L and R in FIG. 1 respectively indicate a left side and a right side of the printer 1.

As shown in FIG. 1, in an apparatus body 2 of the color printer 1, a sheet feeding cartridge 3 storing a sheet S, a sheet feeding device 5 feeding the sheet S from the sheet feeding cartridge 3, an image forming part 7 forming a toner image of full color onto the sheet S, a fixing device 9 fixing the toner image to the sheet S, a sheet ejecting device 11 ejecting the sheet S having the fixed toner image and an ejected sheet tray 13 receiving the ejected sheet S are provided. As shown in FIG. 2, the sheet feeding cartridge 3, the sheet feeding device 5, the image forming part 7, the fixing device 9 and the sheet ejecting device 11 are electrically connected with the controller 15.

The image forming part 7 included image forming units 19 respectively provided for toners of four colors (yellow, magenta, cyan and black), an intermediate transferring unit 21 and toner containers 23 containing toners of respective colors.

Each of the image forming units 19 includes a photosensitive drum 25 as a rotatable image carrier. The photosensitive drum 25 is rotated at any one of first rotating rate and second rotating rate slower than the first rotating rate. The first rotating rate is rotating rate in a case where the sheet S is a plain paper and the second rotating rate is rotating rate in a case where the sheet S is a cardboard. Since stiffness of the cardboard is stronger than stiffness of the plain paper, the cardboard is conveyed at conveying speed slower than a case of the plain paper. Around the photosensitive drum 25, a charging device 27, a developing device 29 and a cleaning device 31 are arranged in sequential order in a rotating direction of the photosensitive drum 25.

The intermediate transferring unit 21 includes an endless intermediate transferring belt 33 circulatingly running and four first transferring rollers 35 arranged in a hollow portion of the intermediate transferring belt 33. Each of the first transferring rollers 35 faces to the corresponding photosensitive drum 25 across the intermediate transferring belt 33. Each of the first transferring rollers 35 composes a first transferring part 37 between the intermediate transferring belt 33 and the photosensitive drum 25 as a transferring device transferring the toner image formed on the photosensitive drum 25 onto the intermediate transferring belt 33. Moreover, at one end of the intermediate transferring belt 33, a second transferring roller 39 is arranged to face to the end, and then, a second transferring part 41 is composed between the intermediate transferring belt 33 and the second transferring roller 39.

In the apparatus body 2, a conveyance path 43 for the sheet S is arranged from the sheet feeding cartridge 3 toward the sheet ejecting device 11 through the second transferring part 41 and the fixing device 9.

The controller 15 controls the sheet feeding device 5, the image forming part 7, the fixing device 9 and the sheet ejecting device 11 to execute following image forming operation. In each of the image forming units 19, the photosensitive drum 25 is electrically charged by the charging device 27 and exposed according to image data by the exposing device 17, and then, an electrostatic latent image is formed on photosensitive drum 25. The developing device 29 develops the electrostatic latent image to the toner image. The first transferring part 37 transfers the toner image from the photosensitive drum 25 onto the intermediate transferring belt 33. Toner images developed by the four image forming units 19 are transferred onto the intermediate transferring belt 33, and then, the toner image of full color is formed on the intermediate transferring belt 33. The cleaning device 31 removes toners remained on photosensitive drums 25.

The controller 15 controls conveyance of the sheet S in accordance with the above-described image forming operation. The sheet S is picked up from the sheet feeding cartridge 3 by the sheet feeding device 5 and conveyed along the conveyance path 43 through the second transferring part 41 and the fixing device 9 to the sheet ejecting device 11. In the second transferring part 41, the toner image of full color formed on the intermediate transferring belt 33 is transferred onto the sheet S. In the fixing device 9, the toner image of full color is fixed to the sheet S. The sheet ejecting device 11 ejects the sheet S having the fixed toner image to the ejected sheet tray 13.

In addition, the color printer 1 includes an operation panel 45 (refer to FIG. 2) electrically connected with the controller 15. The operation panel 45 is provided with a selection button used for selecting a kind (the plain paper or the cardboard) of the sheet S. When the cardboard is selected by the selection button, the controller 15 controls so that the sheet S is conveyed at speed slower than the plain paper. According to this, rotating rate of the photosensitive drum 25 is switched from the first rotating rate to the second rotating rate slower than the first rotating rate.

Figure 3:
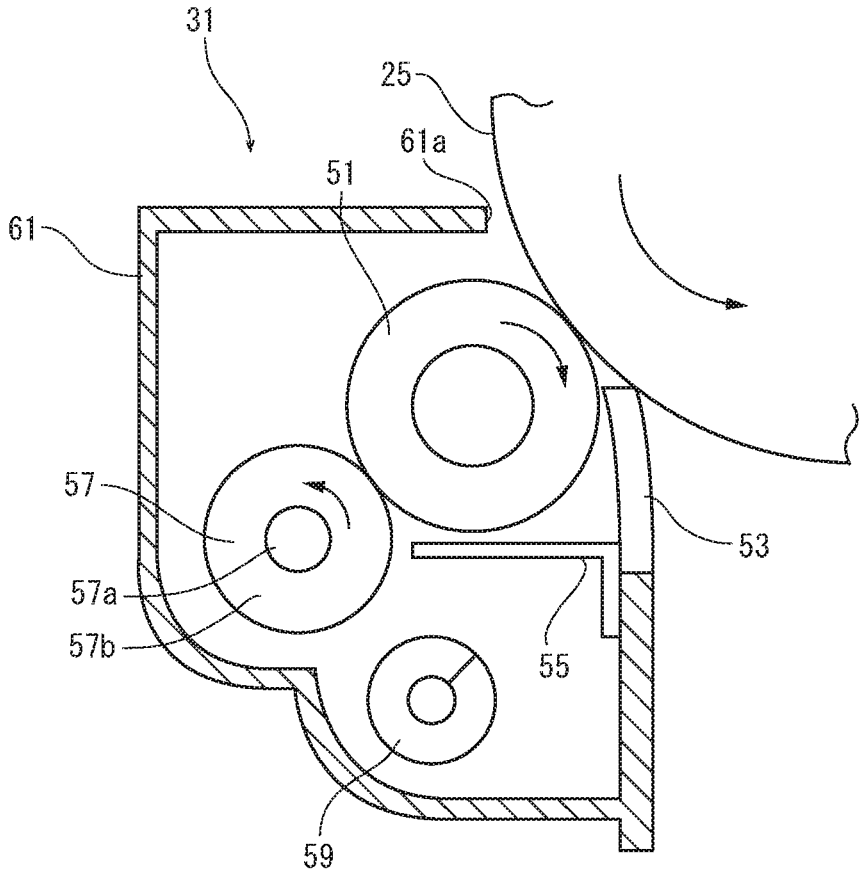
FIG. 3 is a sectional view showing a cleaning device according to the embodiment of the present disclosure.
Figure 4:
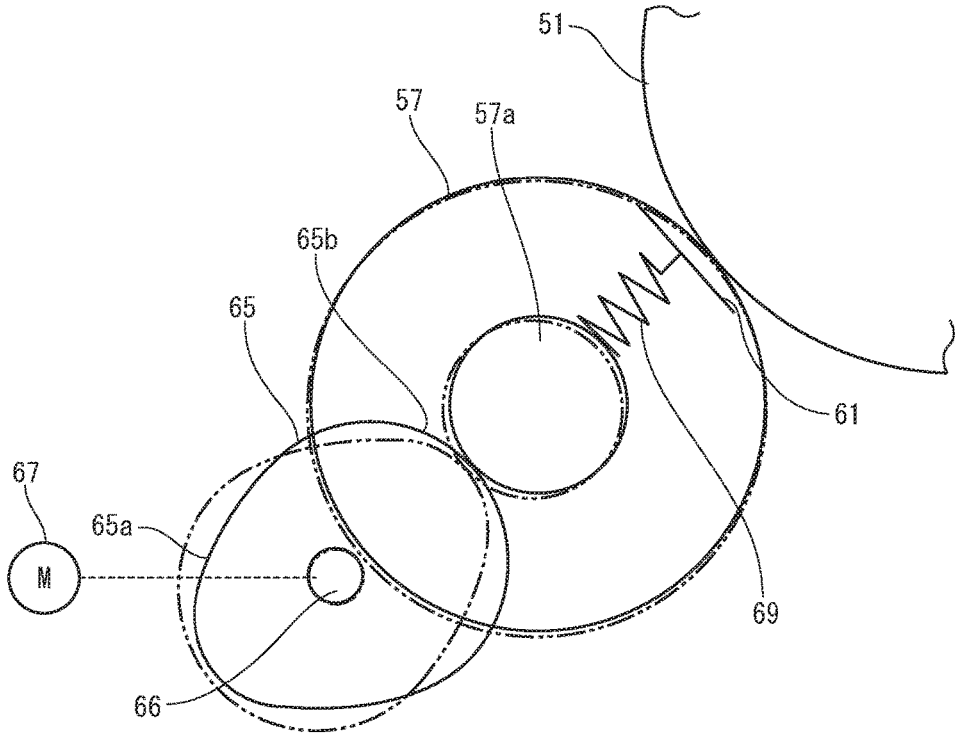
FIG. 4 is a side view showing a layer regulating roller in a moving state in the cleaning device according to the embodiment of the present disclosure.

Next, with reference to FIGS. 3 and 4, the cleaning device 31 will be described. FIG. 3 is a sectional view of the cleaning device 31 and FIG. 4 is a side view of a layer regulating roller 57.

As shown in FIG. 3, the cleaning device includes a cleaning roller 51, a cleaning blade 53, a toner layer forming member 55, the layer regulating roller 57 and a collecting screw 59. The cleaning roller 51 comes into contact with the photosensitive drum 25 and is rotated. The cleaning blade 53 comes into contact with the photosensitive drum 25 at a downstream side from the cleaning roller 51 in the rotating direction of the photosensitive drum 25. The toner layer forming member 55 is arranged below a contact position of the cleaning blade 53 and the photosensitive drum 25. The layer regulating roller 57 is a regulating member coming into contact with the cleaning roller 51 at a downstream side from the toner layer forming member 55 in a rotating direction of the cleaning roller 51 and regulating layer thickness of a toner layer on the cleaning roller 51. The collecting screw 59 is arranged below the toner layer forming member 55. The cleaning roller 51, the cleaning blade 53, the toner layer forming member 55, the layer regulating roller 57 and the collecting screw 59 are housed in a housing 61.

The housing 61 has a hollowing portion elongated in a rotation axis direction of the photosensitive drum 25. At a right upper corner of the housing 61, an opening 61*a* facing to the photosensitive drum 25 is formed.

The cleaning roller 51 has a core metal and an elastic layer provided around an outer circumference face of the core metal. The core metal is made of, for example, metal and the elastic layer is made of, for example, foamed rubber. The cleaning roller 51 is rotatably supported by the housing 61 so as to contact with the photosensitive drum 25 through opening 61*a* and is rotated in an opposite direction to the photosensitive drum 25. Peripheral speed of the cleaning roller 51 is set slightly faster than peripheral speed of the photosensitive drum 25. By such rotation, the cleaning roller 51 remove remained toner and discharge product from a surface of the photosensitive drum 25 and grinds the surface of the photosensitive drum 25.

The cleaning blade 53 is a plate member made of elastic material. As elastic material, for example, urethane rubber can be used. The cleaning blade 53 is attached along a lower edge of the opening 61*a* and contact with the photosensitive drum 25 in a counter direction at a downstream side from the cleaning roller 51 in the rotating direction of the photosensitive drum 25. According to this, the toner adhered on the photosensitive drum 25 is scraped by an edge of the cleaning blade 53. A gap is arranged between the cleaning blade 53 and the cleaning roller 51 and the scraped toner is dropped via this gap.

The toner layer forming member 55 is a plate member having an equivalent length to the cleaning roller 51. The toner layer forming member 55 is fixedly attached to the housing 61 so as to horizontally extend from a lower side of the contact position of the cleaning blade 53 and the photosensitive drum 25 to a lower side of the cleaning roller 51. The toner scraped from the surface of the photosensitive drum 25 is dropped on the toner layer forming member 55 via the gap between the cleaning blade 53 and the cleaning roller 51.

The layer regulating roller 57 has a core metal 57*a* and an elastic layer 57*b* provided around an outer circumference face of the core metal 57*a*. The core metal 57*a* is made of, for example, metal and the elastic layer 57*b* is made of, for example, foamed rubber. The layer regulating roller 57 is supported by the housing 61 at a downstream side from the toner layer forming member 55 in the rotating direction of the cleaning roller 51 and is movable in an approaching direction and in a separating direction with respect to the cleaning roller 51.

A mechanism moving the layer regulating roller 57 will be described with reference to FIG. 4. The mechanism moving the layer regulating roller 57 is composed of a pair of eccentric cams 65 and a pair of springs 69. The pair of eccentric cams 65 are arranged so as to respectively correspond with both ends of the core metal 57*a* of the layer regulating roller 57 and rotated together with a rotating shaft 66 in parallel with the core metal 57*a*. An outer circumference face of each of the eccentric cams 65 has a small diameter portion 65*a* having a relatively small semidiameter from a rotation center to the outer circumference face and a large diameter portion 65*b* having a relatively large semidiameter from the rotation center to the outer circumference face. The rotating shaft 66 is supported by the housing 61 and rotated by a cam motor 67. The cam motor 67 is controlled by the controller 15 (refer to FIG. 2) to drive and to rotate the rotating shaft 66. The pair of springs 69 biases both ends of the core metal 57*a* to make the core metal 57*a* come into contact with the eccentric cams 65.

In a state that the large diameter portion 65*b* of each of the eccentric cams 65 comes into contact with the core metal 57*a* (refer to a solid line in FIG. 4), the core metal 57*a* is pressed in the approaching direction with respect to the cleaning roller 51 by the eccentric cams 65 and the layer regulating roller 57 contacts with the cleaning roller 51. Pressure between the rollers 57 and 51 in this state is a first pressure. In a state that the eccentric cams 65 are rotated and the small diameter portion 65*a* comes into contact with the core metal 57*a* (refer to a two-dot chain line in FIG. 4), the core metal 57*a* is pressed in the separating direction with respect to the cleaning roller 51 by the springs 69 and the pressure between the layer regulating roller 57 and the cleaning roller 51 is switched to a second pressure lower than the first pressure. The layer regulating roller 57 is rotated in an opposite direction to the cleaning roller 51 by following the cleaning roller 51.

With reference to FIG. 3, the collecting screw 59 is rotatably supported by the housing 61 below the gap between the toner layer forming member 55 and the layer regulating roller 57. The collecting screw 59 conveys the toner dropped from the toner layer forming member 55 toward a collecting container (not shown).

In the color printer 1 having the above-described configuration, in a case where the plain paper is selected by the operation panel 45, the photosensitive drum 25 is controlled so as to be rotated at the first rotating rate. Moreover, in the cleaning device 31, the rotating shaft 66 is driven by the cam motor 67 and rotated, and then, the eccentric cams 65 are rotated so that the large diameter portion 65*b* comes into contact with the core metal 57*a* of the layer regulating roller 57 (refer to a solid line in FIG. 4). That is, the pressure between the layer regulating roller 57 and the cleaning roller 51 is set to the first pressure. After image forming operation, toner remained on the photosensitive drum 25 and discharge product adhered on the photosensitive drum 25 are scraped by the cleaning roller 51 and the cleaning blade 53. The scraped toner and others are dropped on a top face of the toner layer forming member 55 through between the cleaning roller 51 and the cleaning blade 53 and collected. The dropped toner is fed to the cleaning roller 51 by the pressure between the cleaning roller 51 and the layer regulating roller 57 and carried by the cleaning roller 51.

The toner carried by the cleaning roller 51 is pressured between the layer regulating roller 57 and the cleaning roller 51 and a toner layer with a predetermined thickness is made. The toner layer is pressured by the photosensitive drum 25 to scrape adhered substance from the surface of the photosensitive drum 25 and simultaneously to grind the surface of the photosensitive drum 25. Thereby, the surface of the photosensitive drum 25 is cleaned.

On the other hand, when the cardboard is selected by the operation panel 45, as described above, the rotating rate of the photosensitive drum 25 is switched to the second rotating rate slower than the first rotating rate. Further, the controller 15 drives the cam motor 67 to rotate the rotating shaft 66, and then, makes the small diameter portion 65*a* come into contact with the core metal 57*a* of the layer regulating roller 57 (refer to a two-dot chain line in FIG. 4). Thereby, the pressure between the layer regulating roller 57 and the cleaning roller 51 is switched to the second pressure lower than the first pressure. That is, pressing force of the layer regulating roller 57 with respect to the cleaning roller 51 is reduced and thickness of the toner layer formed on the cleaning roller 51 becomes thick. By this toner layer, adhered substance is scraped from the surface of the photosensitive drum 25 and the surface of the photosensitive drum 25 is grinded.

As described above, in the cleaning device of the present disclosure, in a case where rotating rate of the photosensitive drum 25 becomes slower than rotating rate when the plain paper is passed, such as a case where image forming operation is carried out for the cardboard, by thickening the toner layer formed on the cleaning roller 51, performance grinding the surface of the photosensitive drum 25 is improved. Therefore, even if rotating rate of the photosensitive drum 25 is slow, since it is possible to certainly grind the surface of the photosensitive drum 25, image flow due to adhering of discharge product hardly occurs. Moreover, when thickness of the toner layer of the cleaning roller 51 becomes thick, it is possible to improve water absorbing power of the toner layer from the surface of the photosensitive drum 25 and to obtain an effect restraining image flow.

Moreover, by moving the layer regulating roller 57 in the approaching direction and in the separating direction with respect to the cleaning roller 51 with a simple mechanism using the eccentric cams 65 and the springs 69, it is possible to regulate thickness of the toner layer formed on the cleaning roller 51. Incidentally, a way regulating thickness of the toner layer is not restricted by this mechanism. For example, thickness of the toner layer formed on the cleaning roller may be regulated by using the toner layer forming member 55.

The present embodiment was described about an example of the photosensitive drum 25 rotating at two rotating rates of the first rotating rate and the second rotating rate, but the photosensitive drum 25 may be configured to rotate at two or more rotating rates. In such a case, as rotating rate becomes slower, the layer regulating roller 57 is controlled so that thickness of the toner layer becomes thicker. Moreover, as an example of the second rotating speed of the photosensitive drum 25, rotating rate in a case where the cardboard is passed was cited, the present disclosure can be applied a case where rotating rate of the photosensitive drum 25 is set slower than a predetermined rate in accordance with surrounding environment (temperature and humidity) and other cases.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A cleaning device comprising:

a cleaning roller coming into contact with a surface of a rotating image carrier and rotating;

a cleaning blade coming into contact with the image carrier at a downstream side from the cleaning roller in a rotating direction of the image carrier and scraping toner adhered to the image carrier;

a toner layer forming member receiving and collecting the toner scraped by the cleaning blade and feeding the toner to the cleaning roller to form a toner layer on the cleaning roller; and a regulating member coming into contact with the cleaning roller to regulate thickness of the toner layer, wherein the regulating member is controlled so as to thicken thickness of the toner layer formed on the cleaning roller as rotating rate of the image carrier becomes slower.

2. The cleaning device according to claim 1, wherein the regulating member is configured to be movable in an approaching direction and in a separating direction with respect to the cleaning roller, and, is controlled so as to move in the separating direction with respect to the cleaning roller as rotating rate of the image carrier becomes slower, and then, reduces pressing force of the regulating member with respect to the cleaning roller to thicken thickness of the toner layer.

3. The cleaning device according to claim 1, wherein the image carrier is configured so as to rotate at first rotating rate and second rotating rate slower than the first rotating rate, the regulating member is controlled so as to thicken thickness of the toner layer formed on the cleaning roller in a case where rotating rate of the image carrier is switched from the first rotating rate to the second rotating rate.

4. The cleaning device according to claim 1, wherein the toner layer forming member is arranged below a contact position of the cleaning blade and the image carrier;

the regulating member is a layer regulating roller comes into contact with the cleaning roller at a downstream side from the toner layer forming member in a rotating direction of the cleaning roller to regulate thickness of the toner layer.

5. The cleaning device according to claim 2, wherein a mechanism moving the regulating member is composed of an eccentric cam and a spring.

6. An image forming apparatus comprising:

the cleaning device according to claim 1; and the image carrier.

7. An image forming apparatus comprising:

the cleaning device according to claim 2; and the image carrier.

8. An image forming apparatus comprising:

the cleaning device according to claim 3;

the image carrier; and a transferring device transferring a toner image formed on the image carrier to a sheet, wherein the cleaning device removes toner remained on the image carrier after the toner image is transferred to the sheet by the transferring device, the first rotating rate is rotating rate in a case where the sheet is a plain paper and the second rotating rate is rotating rate in a case where the sheet is a cardboard.

9. An image forming apparatus comprising:

the cleaning device according to claim 4; and the image carrier.

10. An image forming apparatus comprising:

the cleaning device according to claim 5; and the image carrier.

* * * * *